US011052702B2

(12) United States Patent
Quinn

(10) Patent No.: US 11,052,702 B2
(45) Date of Patent: Jul. 6, 2021

(54) RESEALABLE WET OR DRY APPLICATION ROLLER APPARATUS CONTAINER WITH A SINGLE USE DISPOSABLE LINER INSERT

(71) Applicant: Craig Stephen Quinn, North Lauderdale, FL (US)

(72) Inventor: Craig Stephen Quinn, North Lauderdale, FL (US)

( * ) Notice: Subject to any disclaimer, the term of this patent is extended or adjusted under 35 U.S.C. 154(b) by 73 days.

(21) Appl. No.: 16/364,110

(22) Filed: Mar. 25, 2019

(65) Prior Publication Data

US 2020/0079138 A1 Mar. 12, 2020

Related U.S. Application Data

(60) Provisional application No. 62/728,237, filed on Sep. 7, 2018.

(51) Int. Cl.
*B44D 3/12* (2006.01)

(52) U.S. Cl.
CPC ..... *B44D 3/125* (2013.01)

(58) Field of Classification Search
CPC ..... B65D 77/0486; B44D 3/125; B44D 3/00; B44D 3/12
USPC ..... 206/361; 220/495.01–495.11, 592.23, 220/592.17; 119/61.5
See application file for complete search history.

(56) References Cited

U.S. PATENT DOCUMENTS

| | | | | |
|---|---|---|---|---|
| 5,074,098 | A * | 12/1991 | Filipchuk | B44D 3/125 53/397 |
| 5,533,617 | A * | 7/1996 | Von Flatern | B44D 3/125 206/15.3 |
| 5,562,208 | A * | 10/1996 | Hasler | B25F 1/00 206/373 |
| 5,709,301 | A * | 1/1998 | Couch | B44D 3/125 206/15.3 |
| 5,915,552 | A * | 6/1999 | Kim | B44D 3/125 206/15.3 |
| 6,530,470 | B2 * | 3/2003 | Roundy | B44D 3/00 15/257.06 |
| 7,552,819 | B2 * | 6/2009 | Fernandes | B44D 3/125 206/15.3 |
| 2003/0188980 | A1 * | 10/2003 | Myers | B44D 3/125 206/361 |
| 2007/0017836 | A1 * | 1/2007 | Kohs | B44D 3/125 206/361 |
| 2007/0295626 | A1 * | 12/2007 | Mowe | B65D 81/261 206/361 |
| 2011/0005952 | A1 * | 1/2011 | Fenn | B44D 3/125 206/361 |
| 2016/0229224 | A1 * | 8/2016 | Lester, III | B65D 55/16 |

* cited by examiner

*Primary Examiner* — Chun Hoi Cheung

(57) ABSTRACT

A resealable wet or dry application roller container, with optional disposable insert liner, for the sealed storage and transportation of a wet or dry application roller, either by itself, or while remaining attached to the application roller frame, and after rolling off any excess paint from a wet application roller, and being sealed within container, with, or without, optional disposable insert liner, does not leak regardless of orientation.

6 Claims, 12 Drawing Sheets

RESEALABLE WET OR DRY APPLICATION ROLLER APPARATUS CONTAINER WITH A SINGLE USE DISPOSABLE LINER INSERT

BACKGROUND OF INVENTION

The present invention is in the technical field of painting. More particularly, the present invention is in the technical field of painting application devices. More particularly, the present invention is in the technical field of paint roller applicators. More particularly, the present invention is in the technical field of paint roller applicator accessories Application rollers utilized in a wet state, cannot be left unutilized in open air for over short periods of time without application products, such as, but not limited to, latex, or oil base products from curing on the roller, and a less desired options, such as, resorting to plastic bags, or even saran/cling wrap, or the like, to attempt to wrap a wet roller, are problematic, as well as application trays for resting application rollers in a wet state, require a flat level surface, and are not easily transportable, and careful handling is required for, but not limited to, the previous examples, or leakages and spillage can occur resulting in undesired spillage, aforementioned product spillage resulting in, but not limited to, damage to any surfaces contacted, other items, and any other objects contacted as a consequence of undesired products such but not limited to latex, or oil base products spillage.

SUMMARY OF THE INVENTION

The present invention is a resealable wet or dry application roller apparatus container and a single use disposable liner insert, for the scaled storage and viable transportation of a wet or dry application roller either by itself or while remaining attached to the application roller frame rod, and after rolling off any excess paint from a wet application roller, and being sealed within said apparatus container, does not leak regardless of orientation. These and other features, aspects and advantages of the present invention will become better understood with reference to the following drawings, description and claims.

DETAILED DESCRIPTION OF THE INVENTION

The following detailed description represents the best currently contemplated modes for carrying out the invention. The description is not to be taken in a limiting sense, but is made merely for the purpose of illustrating the general principles of the invention.

Figure 1:
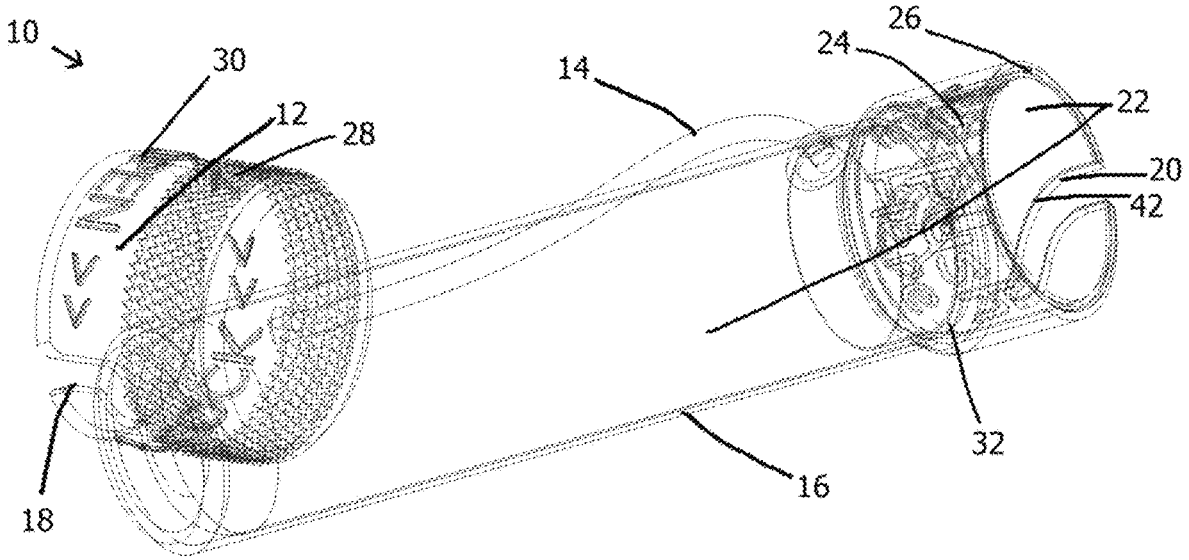
FIG. 1 is a perspective line drawing view of the present invention, a resealable wet or dry application roller container with a detachable slotted cap, and lanyard, and slotted container, and a single use disposable liner insert inserted.
Figure 1A:
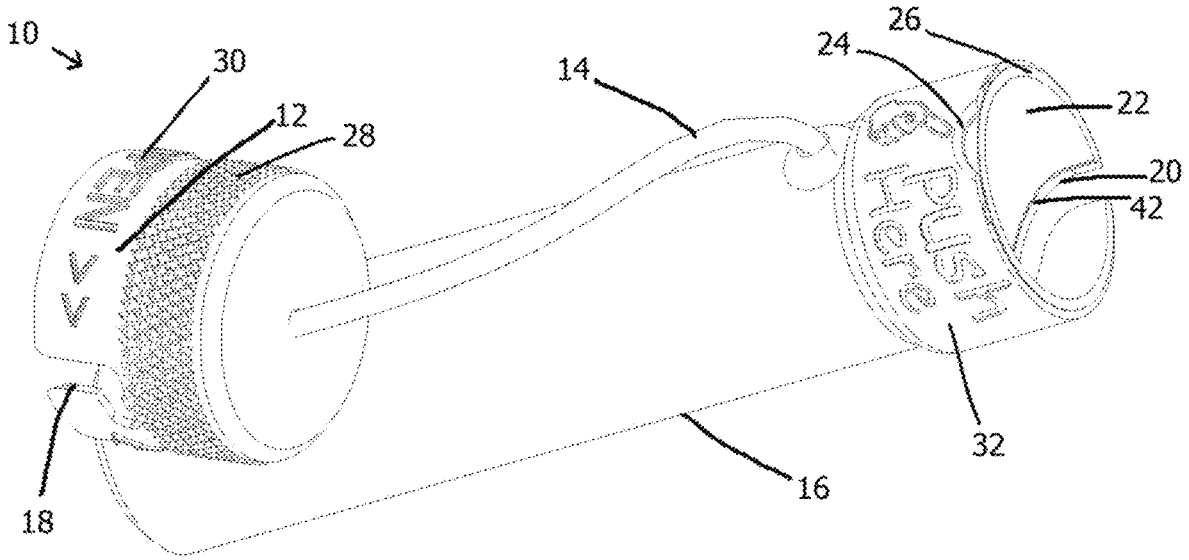
FIG. 1A is a simplified revision of FIG. 1 for further explanation.
Figure 1B:
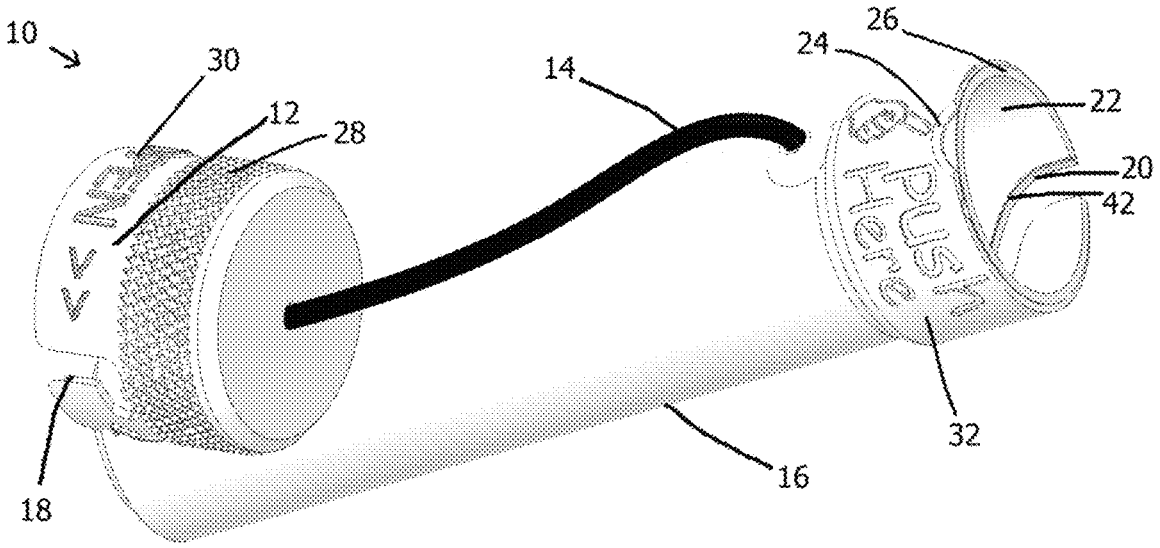
FIG. 1B is a simplified revision of FIG. 1 for further explanation.
Figure 2:
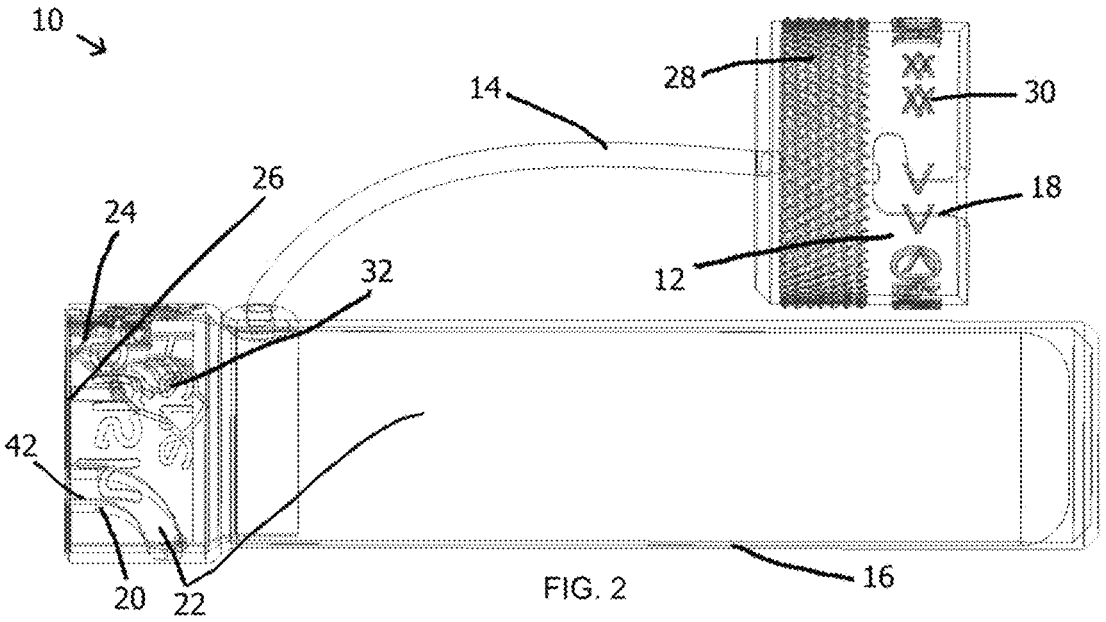
FIG. 2 is a line drawing side view of the resealable wet or dry application roller container with, detachable slotted cap, and lanyard, and slotted container, and a single use disposable liner insert inserted from FIG. 1.
Figure 2A:
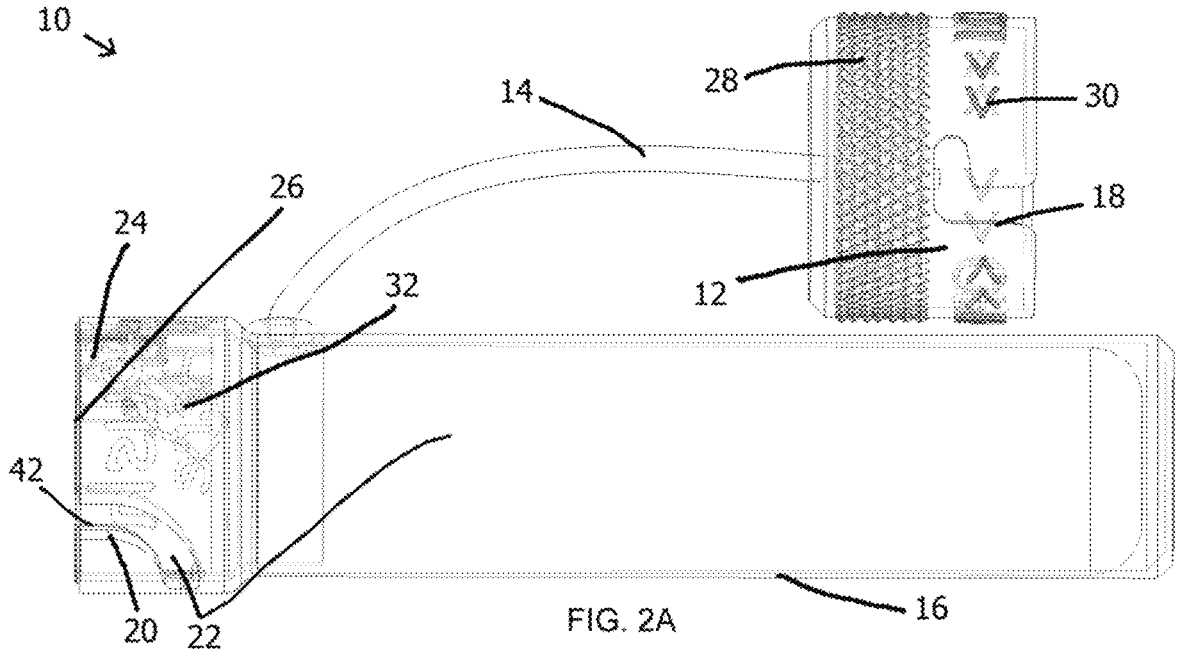
FIG. 2A is a simplified revision of FIG. 2 for further explanation.
Figure 2B:
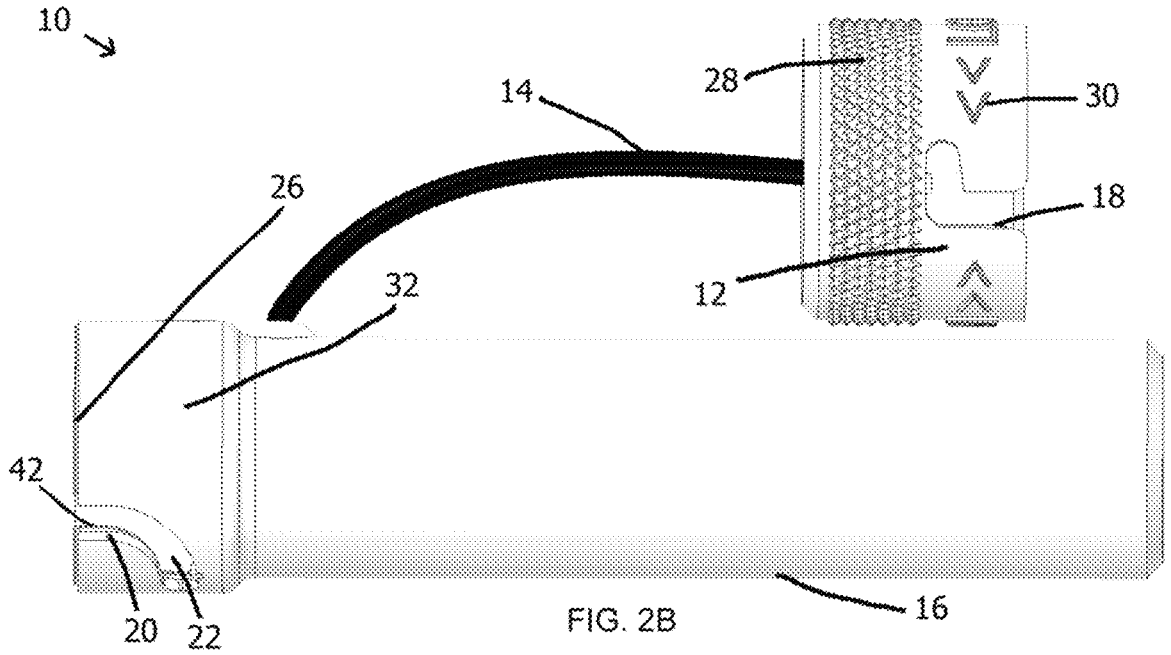
FIG. 2B is a simplified revision of FIG. 2 for further explanation.
Figure 3:
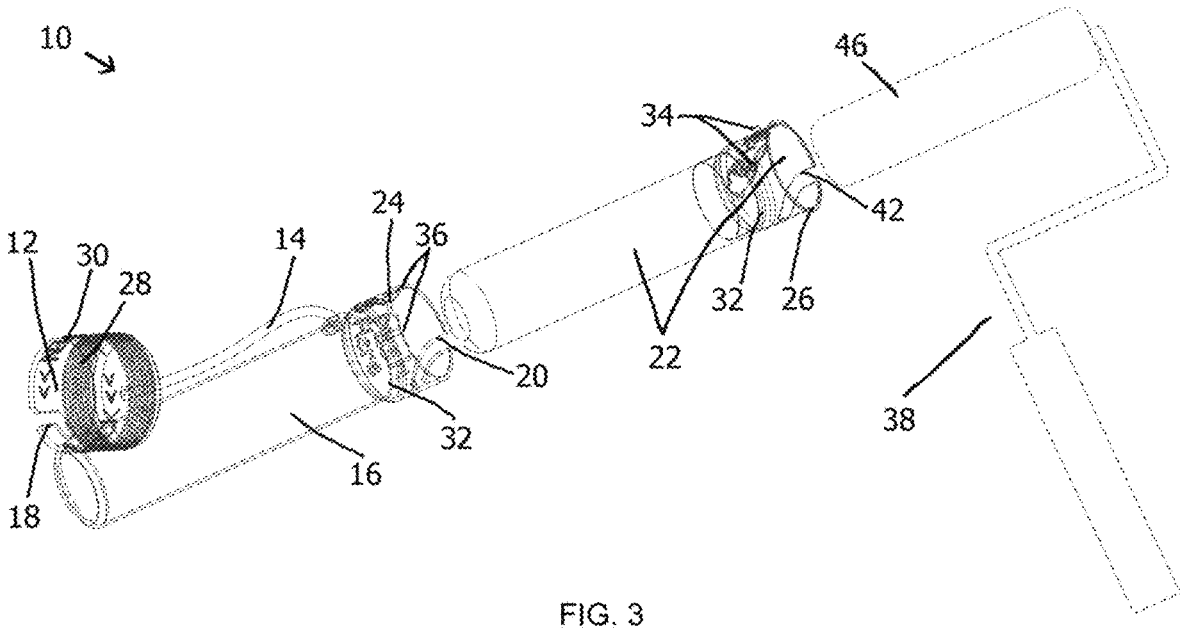
FIG. 3 is a perspective zoomed out view of the resealable wet or dry application roller container with, detachable slotted cap, and lanyard, and slotted container, shown before insertion of the, single use disposable insert liner, and the roller, with roller frame rod attached from FIG. 1.
Figure 3A:
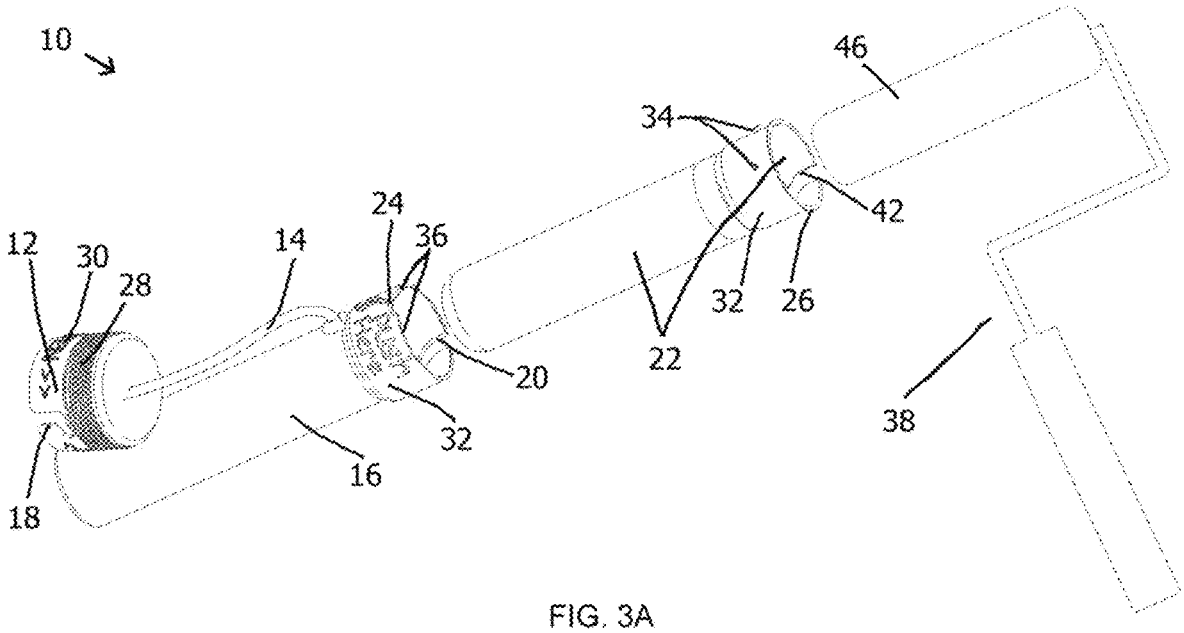
FIG. 3A is a simplified revision of FIG. 3 for further explanation.
Figure 3B:
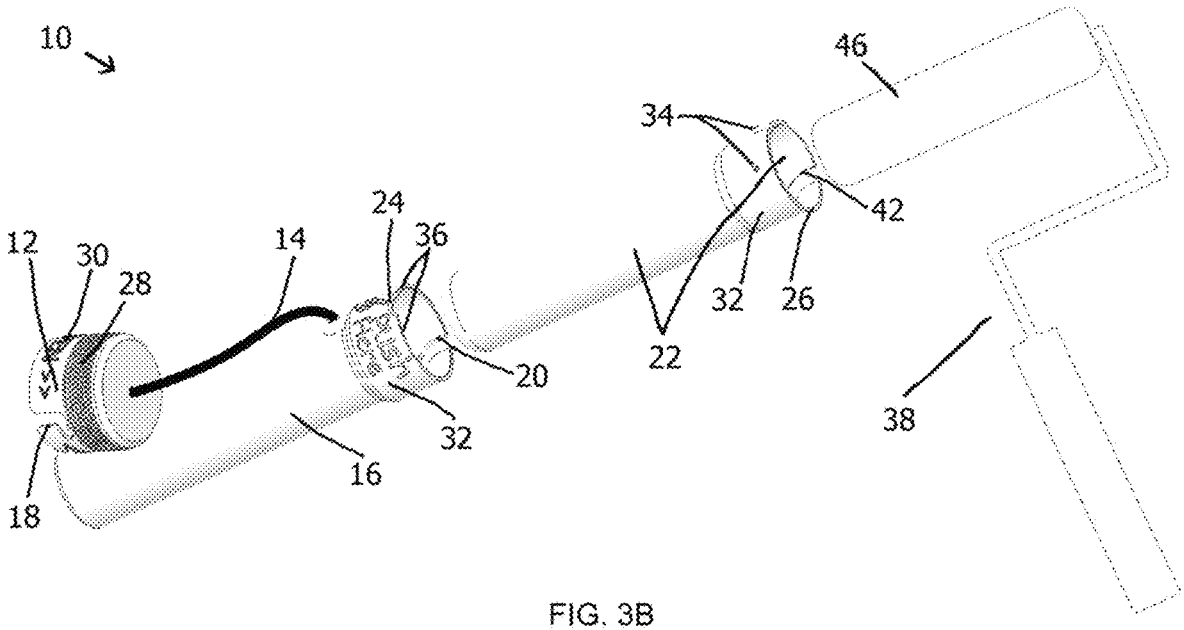
FIG. 3B is a simplified revision of FIG. 3 for further explanation.
Figure 4:
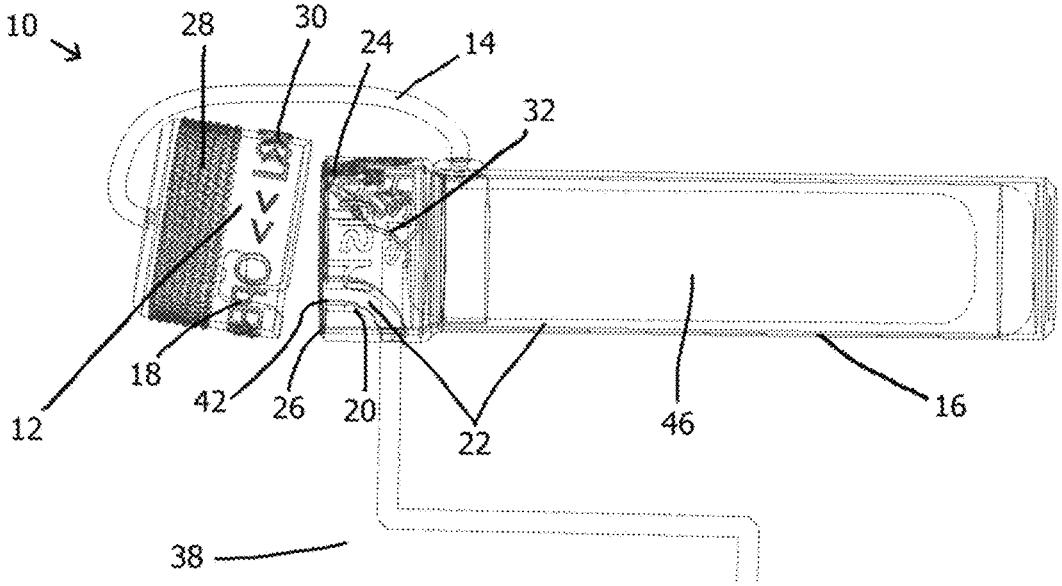
FIG. 4 is a perspective view of the resealable wet or dry application roller container with, detachable slotted cap, and lanyard, and slotted container, with a single use disposable liner insert inserted, and application roller with frame rod inserted, and the detachable slotted cap ready to be attached, from FIG. 1.
Figure 4A:
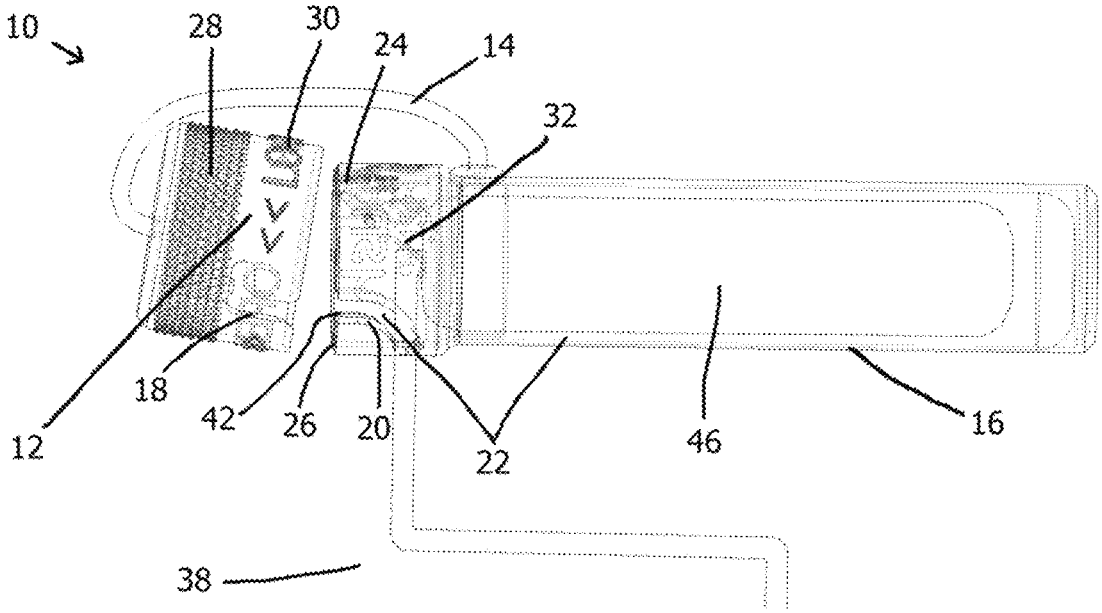
FIG. 4A is a simplified revision of FIG. 4 for further explanation.
Figure 4B:
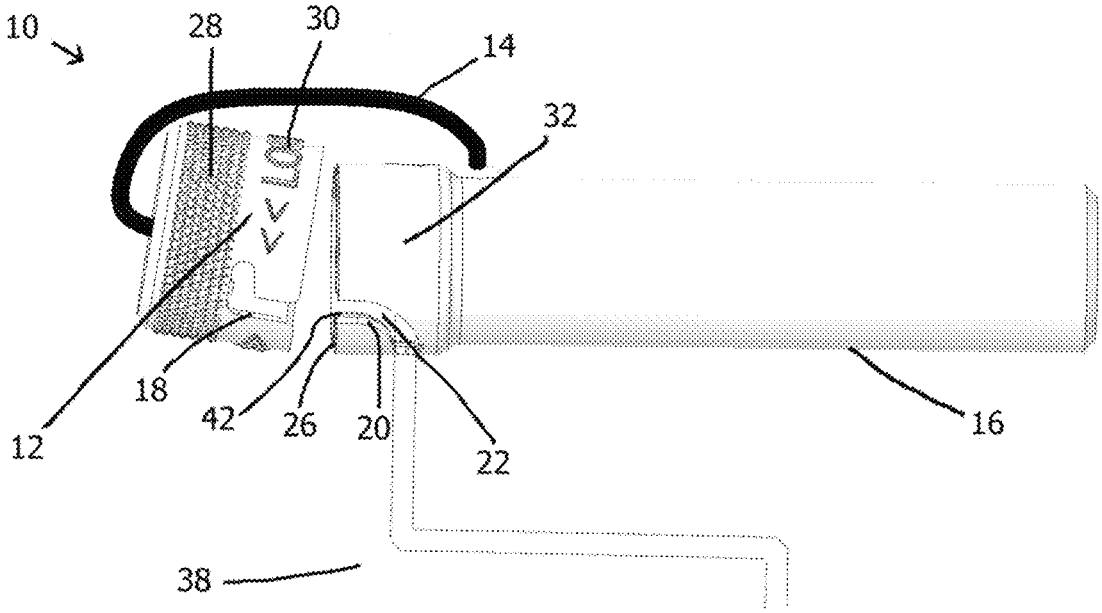
FIG. 4B is a simplified revision of FIG. 4 for further explanation.
Figure 5:
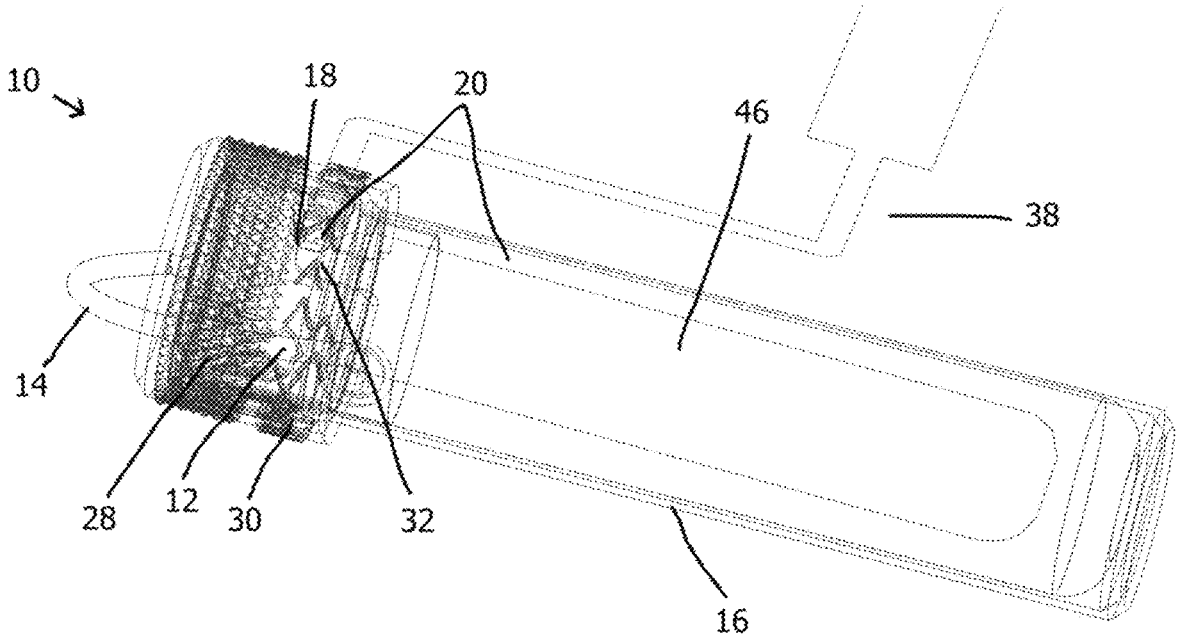
FIG. 5 is a perspective view of the wet or dry application roller container with, detachable slotted cap, and lanyard, and slotted container, with a single use disposable liner insert inserted and application roller with frame rod inserted, and the detachable slotted cap attached from FIG. 1.
Figure 5A:
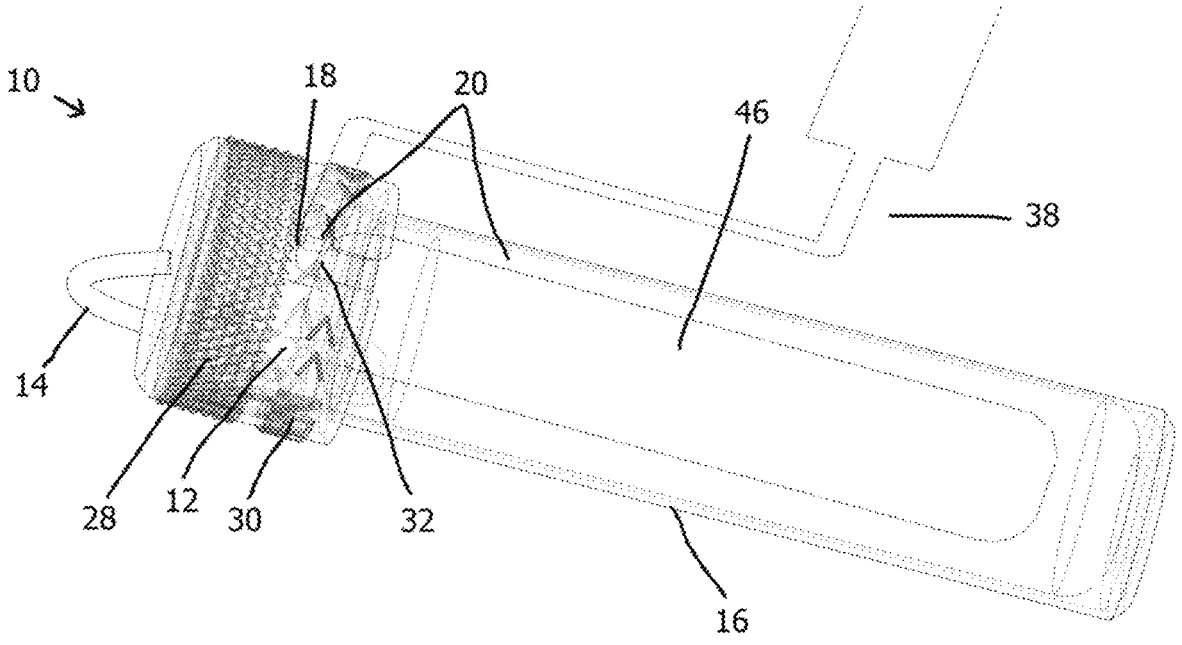
FIG. 5A is a simplified revision of FIG. 5 for further explanation.
Figure 5B:
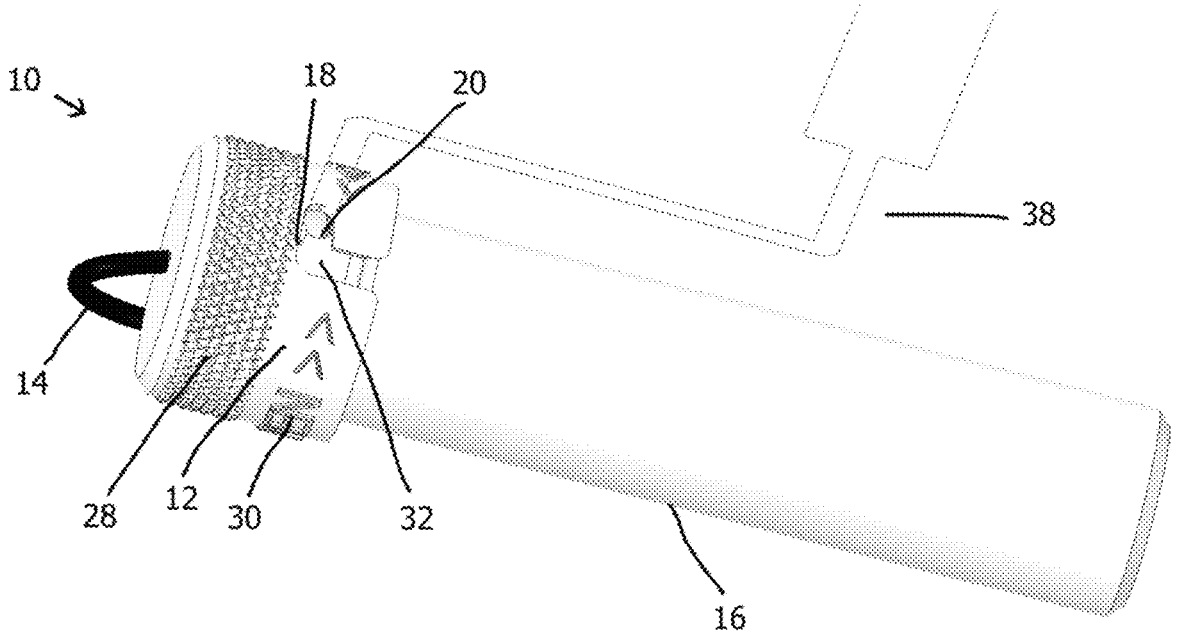
FIG. 5B is a simplified revision of FIG. 5 for further explanation.
Figure 6:
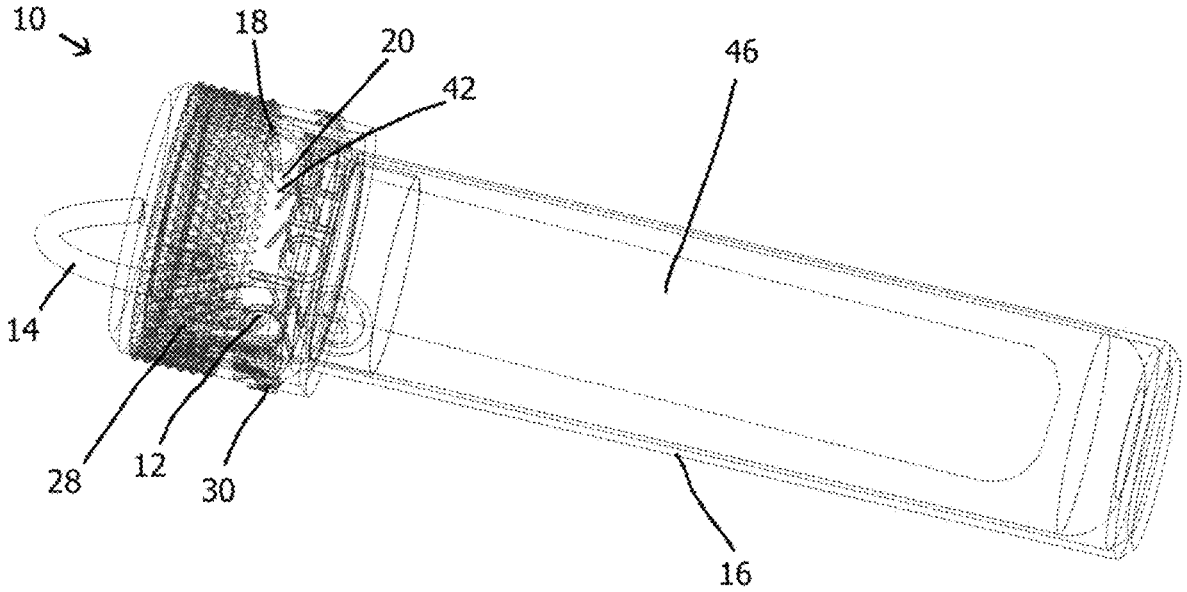
FIG. 6 is a perspective view of the wet or dry application roller container with, detachable slotted cap, and lanyard, and slotted container, with a single use disposable liner insert inserted and application roller inserted, and the detachable slotted cap attached, however pivotably rotated in such a way as to misalign the slots on the detachable slotted cap and on the slotted container, resulting in a seal, of the application roller without the frame rod attached from FIG. 1.
Figure 6A:
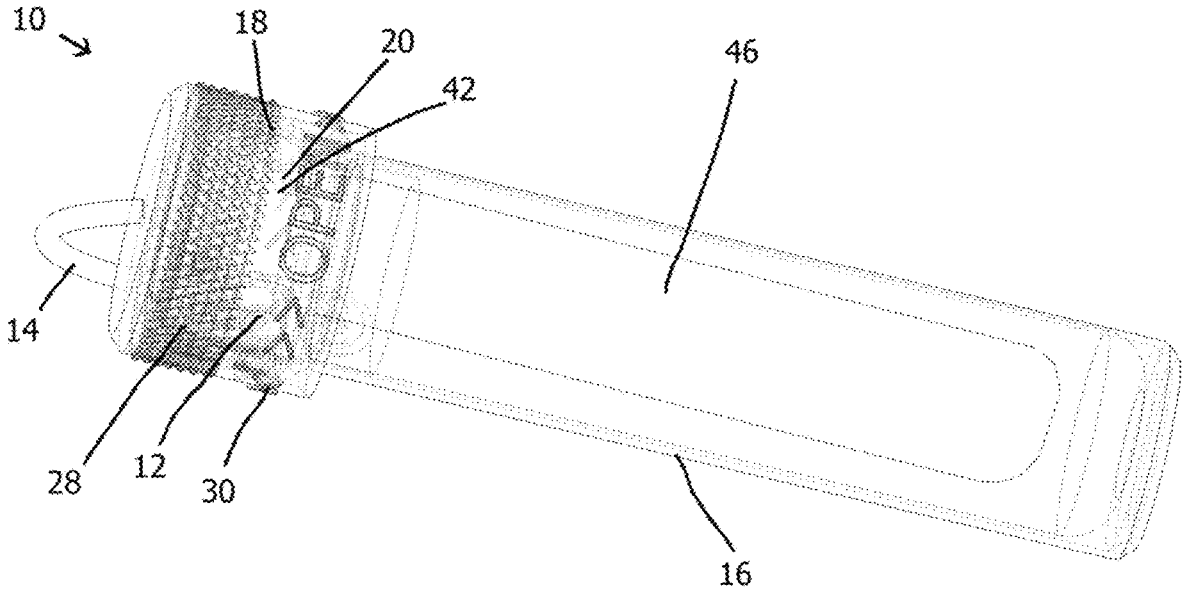
FIG. 6A is a simplified revision of FIG. 6 for further explanation.
Figure 6B:
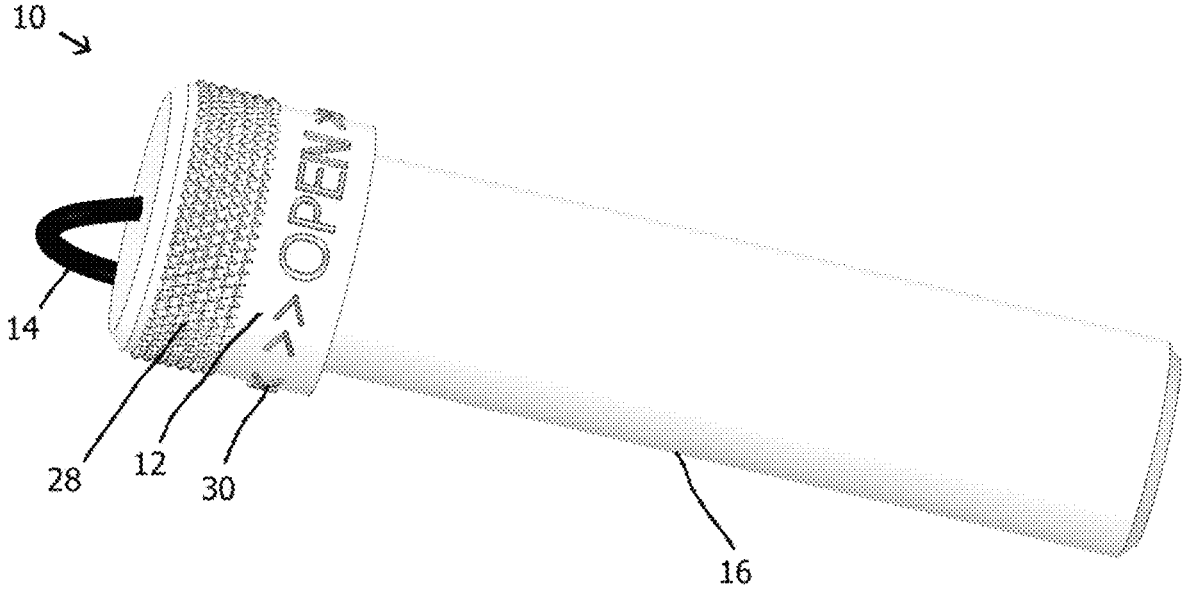
FIG. 6B is a simplified revision of FIG. 6 for further explanation.
Figure 7:
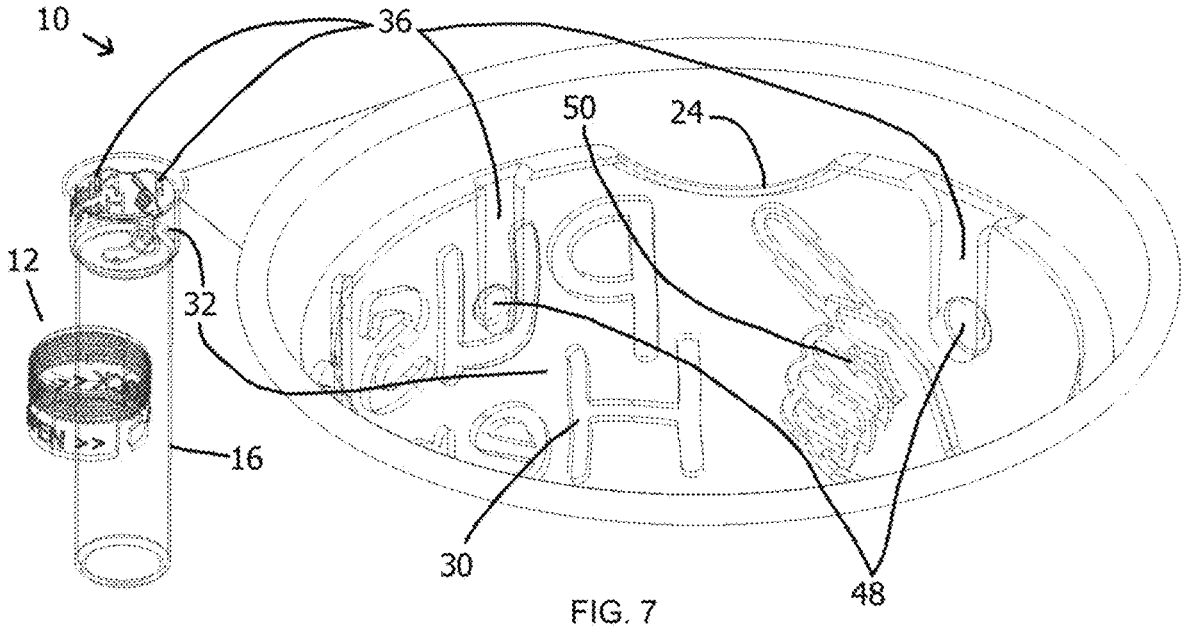
FIG. 7 is a perspective zoomed in view of the wet or dry application roller container with, detachable slotted cap, and lanyard, and slotted container, and without the disposable insert from FIG. 1.
Figure 7A:
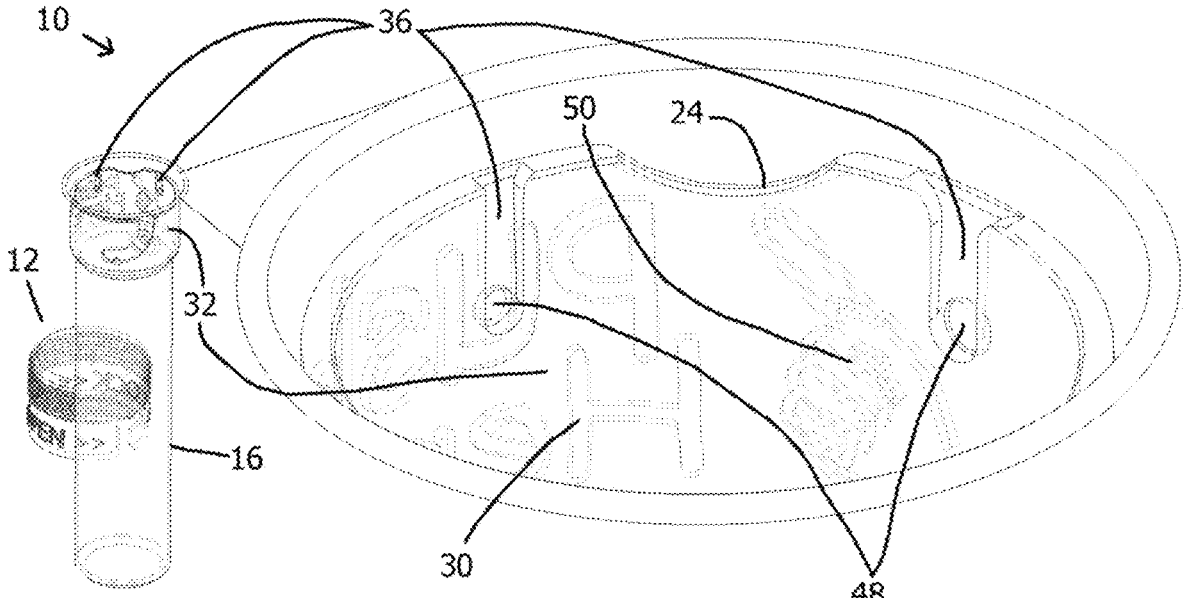
FIG. 7A is a simplified revision of FIG. 7 for further explanation.
Figure 7B:
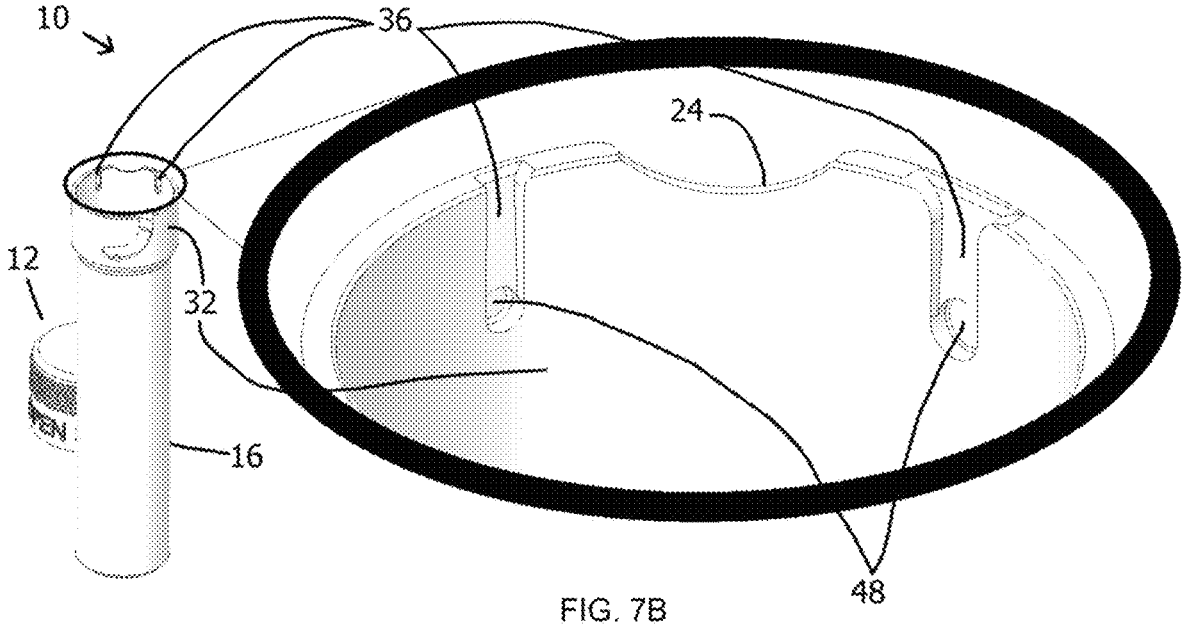
FIG. 7B is a simplified revision of FIG. 7 for further explanation.
Figure 8:
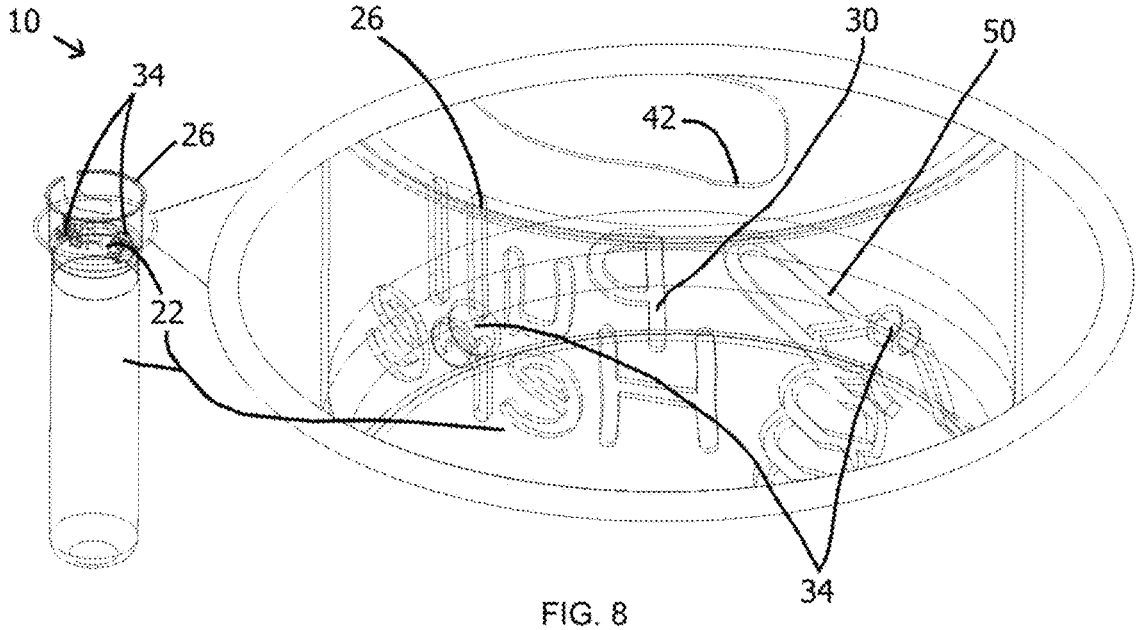
FIG. 8 is a perspective zoomed in view of the single use disposable liner insert from FIG. 1.
Figure 8A:
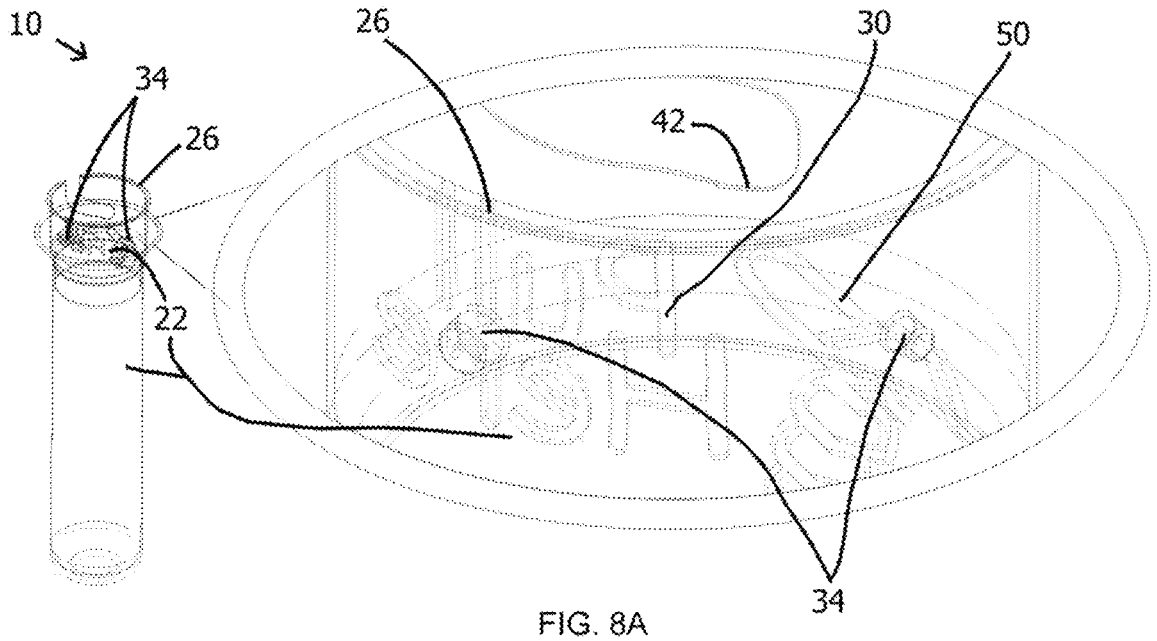
FIG. 8A is a simplified revision of FIG. 8 for further explanation.
Figure 8B:
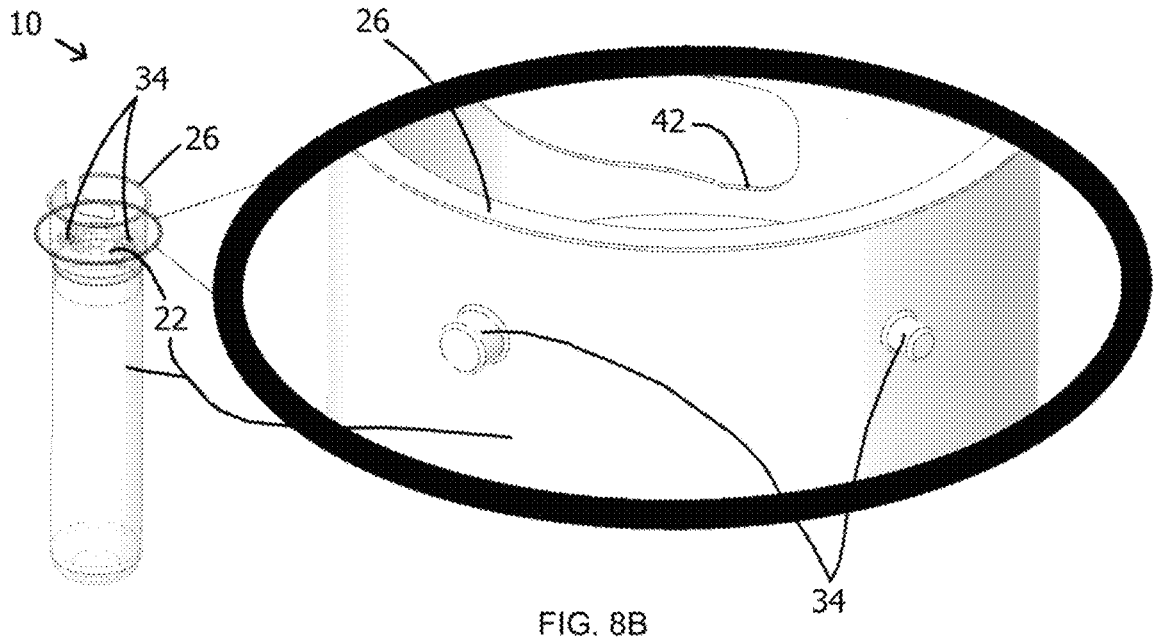
FIG. 8B is a simplified revision of FIG. 8 for further explanation.

The Referring now to the invention in more detail, in FIG. 1, FIG. 2, FIG. 3, FIG. 4, FIG. 5, FIG. 6, there is shown the present invention, a resealable wet or dry application roller apparatus container 10, with a single use disposable liner insert 22, for the sealed storage and viable transportation of a wet or dry application roller 46, either by itself, or while remaining attached to the application roller frame rod 38, and after rolling off any excess paint from a wet application roller 46, and being sealed within said apparatus container 10, with, a single use disposable liner insert 22, does not leak regardless of orientation, for up to, 30 days, in the wet state, and indefinitely in the dry state, thus allowing the stopping and starting of product application, without having to clean the application roller 46 for each stop and start iteration, an elongated cylindrical member 16, comprising of: a hollow body, with one closed end, and one enlarged open end, a slot 20, a concave depression 24 located at a rim of the enlarged open end, and two keyway channels 36 located and begins at the rim of the elongated cylindrical member 16 enlarged open end, with two keyway sockets 48 located at the opposite end of said channels, an elongated, single use disposable liner insert 22, with two alignment keys 34 on the upper portion of the disposable liner insert 22, engages with the two keyway sockets 48 of the elongated cylindrical member 16 when inserted, and locks the disposable liner insert 22 in place for receiving a paint-applying roller, being wet with paint or in a dry state; and a detachable, slotted cap 12, appended by a lanyard 14, to seal the cylindrical member 16 and the liner insert 22, to prevent the drying of paint on the roller, Wherein said two keyway channels 36 recessed deeper at the rim of member enlarged open end, and recessed shallower on the opposing end of the two keyway channels 36 adjacent to the two keyway sockets 48, and provide a semi resistive locking effect for the single use disposable liner insert 22 when inserted with the two alignment keys 34, wherein said detachable slotted cap 12, further comprises raised 3-D knurling 28 and raised 3-D text 30 and any graphic, to provide extra grip for opening and closing, wherein said concave depression 24, located at the rim of elongated cylindrical member 16 enlarged open end provide a finger pull to dislodge and release the single use disposable liner insert 22, wherein said single use disposable liner insert 22, with two alignment keys 34, along with a stop lip 26 to hold the single use disposable liner insert in place within the cylindrical container, finger pressure will dislodge the two alignment keys 34, from two keyway sockets 48 for single use disposable liner insert 22 with raised 3-D knurling 28, and raised 3-D text 30, and any graphic, to provide extra grip for removal or for the replacement of the elongated single use disposable liner insert 22, wherein said resealable wet or dry application roller apparatus container with a single use disposable liner insert 22 for the sealed storage and viable transportation of a wet or dry application roller 46, either by itself, or while remaining attached to an application roller frame rod 38, and after rolling off any excess paint from a wet application roller, and being sealed within said apparatus container 10, with a single use disposable liner insert 22, does not leak regardless of orientation, can be stored for up to 30 days, in the wet state, and indefinitely in the dry state.

The construction details of the invention as shown in FIG. 1, FIG. 2, FIG. 3, FIG. 4, FIG. 5, FIG. 6, arc that the rescalable wet or dry application roller apparatus container 10, with a single use disposable liner insert 22, may be made of, but not limited to, or any combination of, sufficiently rigid or flexible material such as high strength plastic, LDPE, HDPE, TPE, plastic alloys, metal, metal alloys, Poly, PET, ABS, Nylon, TPE, silicone, silicone alloys, and the like, further, the various methods of manufacturing can be, but not limited to, blow mold, injection molding 1, 2, even 3, or 4 Shot Molding, disposable single use liner insert 22, may be made to be but not limited to, collapsible so as to lay flat for packaging, however could also be made to be semi rigid at the top and a collapsible lower portion, so as to be stackable, for packaging, or any combination of.

The invention claimed is:

1. A resealable wet or dry application roller apparatus container with single use disposable liner insert comprises of:

an elongated cylindrical member, comprising of:

a hollow body, with one closed end, and one enlarged open end, a slot, a concave depression located at a rim of the enlarged open end, and two keyway channels located and begins at the rim of the elongated cylindrical member enlarged open end, with two keyway sockets located at the opposite end of said channels, an elongated, single use disposable liner insert, with two alignment keys on the upper portion of the single use disposable liner insert, engages with the two keyway sockets of the elongated cylindrical member when inserted, and locks the single use disposable liner insert in place for receiving a paint-applying roller, being wet with paint or in a dry state; and a detachable, slotted cap, appended by a lanyard, to seal the elongated cylindrical member and the single use disposable liner insert, to prevent the drying of paint on the roller.

2. The resealable wet or dry application roller apparatus container with single use disposable liner insert as in claim 1, wherein said two keyway channels recessed deeper at the rim of member enlarged open end, and recessed shallower on the opposing end of the two keyway channels adjacent to the two keyway sockets, and provide a semi resistive locking effect for the single use disposable liner when inserted with the two alignment keys.

3. The resealable wet or dry application roller apparatus container with single use disposable liner insert as in claim 1 wherein said detachable slotted cap, further comprises raised 3-D knurling and raised 3-D text and any graphic, to provide extra grip for opening and closing.

4. The resealable wet or dry application roller apparatus container with single use disposable liner insert as in claim 1 wherein said concave depression, located at the rim of elongated cylindrical member enlarged open end provide a finger pull to dislodge and release the single use disposable liner insert.

5. The resealable wet or dry application roller apparatus container with single use disposable liner insert as in claim 1 wherein said single use disposable liner insert, with the two alignment keys, along with a stop lip to hold the single use disposable liner insert in place within the elongated cylindrical member, finger pressure will dislodge the two alignment keys, from two keyway sockets for single use disposable liner insert with raised 3-D-knurling, and raised 3-D text, and any graphic, to provide extra grip for removal or for the replacement of the elongated single use disposable liner insert.

6. The resealable wet or dry application roller apparatus container with single use disposable liner insert as in claim 1 wherein said resealable wet or dry application roller apparatus container with the single use disposable liner insert for the sealed storage and viable transportation of the wet or dry application roller, either by itself, or while remaining attached to an application roller frame rod, and after rolling off any excess paint from the wet application roller, and being sealed within said apparatus container, with the single use disposable liner insert, does not leak regardless of orientation, can be stored for up to 30 days, in the wet state, and indefinitely in the dry state.

* * * * *